United States Patent [19]

Spotz

[11] 3,943,951

[45] Mar. 16, 1976

[54] WATER JET CLEANING APPLIANCE

[76] Inventor: Donald R. Spotz, 6261 S. W. 5th Court, Plantation, Fla. 33304

[22] Filed: Nov. 4, 1974

[21] Appl. No.: 520,562

[52] U.S. Cl. ..... 134/100; 134/175; 134/200; 4/1; 4/165

[51] Int. Cl.[2] ..... B08B 3/02

[58] Field of Search ..... 128/66, 370; 134/99–102, 175, 177, 198–200; 4/1, 165

[56] References Cited

UNITED STATES PATENTS

| | | | |
|---|---|---|---|
| 1,438,834 | 12/1922 | Keil | 134/200 X |
| 2,025,936 | 12/1935 | Clearman | 134/102 X |
| 2,394,760 | 2/1946 | Felton | 134/102 X |
| 3,092,120 | 6/1963 | Hilger et al. | 134/100 X |
| 3,276,694 | 10/1966 | Alexander | 134/102 X |
| 3,416,544 | 12/1968 | Paiva | 134/200 X |
| 3,510,108 | 5/1970 | Yego, Jr. | 134/200 X |
| 3,757,806 | 9/1973 | Bhaskar et al. | 134/199 X |
| 3,830,248 | 8/1974 | Brown | 134/198 X |

*Primary Examiner*—Robert L. Bleutge
*Attorney, Agent, or Firm*—Oltman and Flynn

[57] ABSTRACT

The present cleaning appliance has a cleaning chamber for receiving the finger to be cleaned, a jet nozzle at the upper end of this chamber for discharging pressurized water onto the finger, a reservoir for a cleaning solution directly above the cleaning chamber, and a valve controlling the flow of the cleaning solution from the reservoir down into the cleaning chamber. The cleaning solution is conducted separately down to the jet nozzle where it becomes entrained with the water after the latter has just emerged from the jet nozzle.

7 Claims, 6 Drawing Figures

FIG. 1
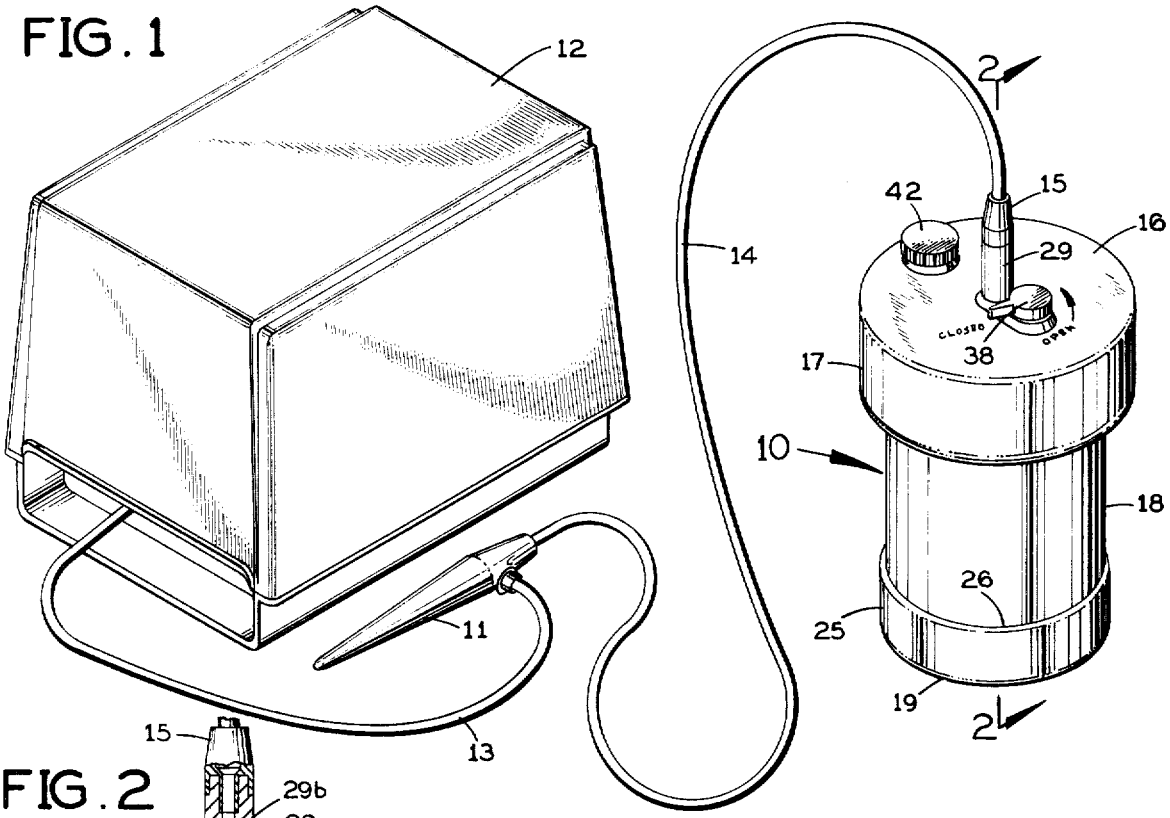
FIG. 2
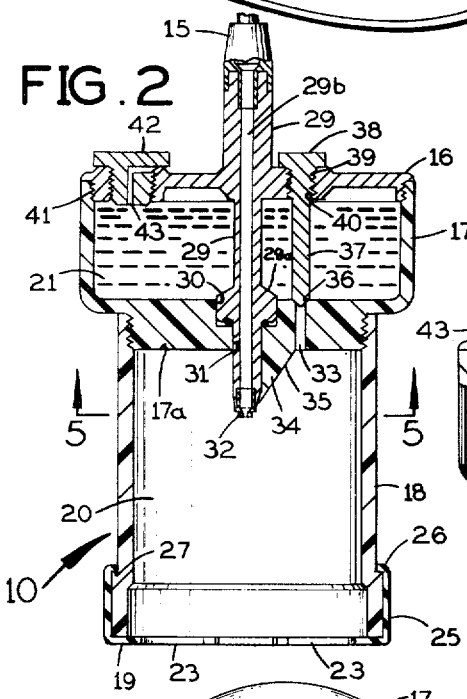
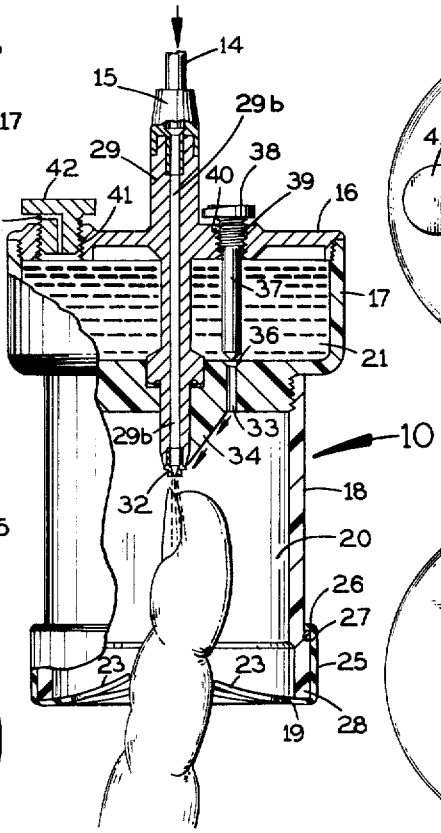
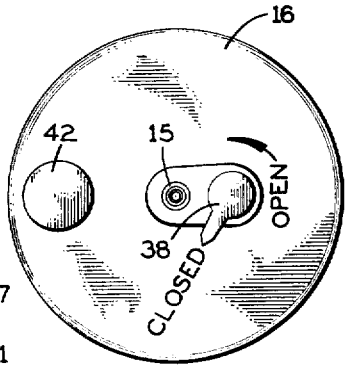
FIG. 3
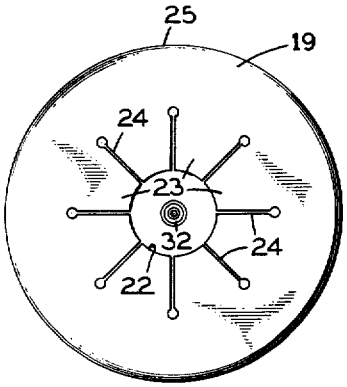
FIG. 4
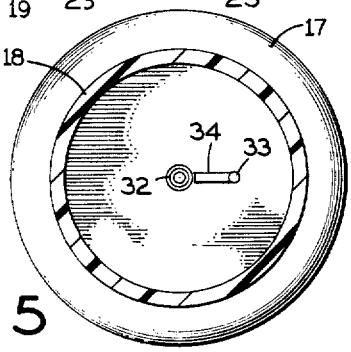
FIG. 5
FIG. 6

WATER JET CLEANING APPLIANCE

BACKGROUND OF THE INVENTION

Various occupations, such as that of automotive mechanics, involve getting the fingers dirty or greasy and often it is rather difficult for such workers to clean their fingers thoroughly, particularly under the finger nails, at the completion of the work day. The same problem exists in households and various occupations such as among hospital and restaurant personnel and in various manufacturing occupations where an exceptionally high degree of personal cleanliness must be maintained. Harsh or abrasive soaps or cleaning compounds are not an entirely adequate answer to this problem, both from the standpoint of effective and thorough cleaning of the hands and from the standpoint of their harmful effects on the skin of some persons.

Various special purpose cleaning appliances have been proposed heretofore, such as the forearm and hand cleaning devices shown in U.S. Pat. No. 3,757,806 to Bhaskar et al. and U.S. Pat. No. 3,699,984 to Davis, and the hand cleaning devices shown in U.S. Pat. No. 3,205,620 to Woodworth et al. and U.S. Pat. No. 3,220,424 to Nelson.

SUMMARY OF THE INVENTION

The present invention is directed to a novel and improved cleaning appliance whose principal utility is believed to be in cleaning the ends of the fingers, particularly under and around the finger nails. In the preferred embodiment, only one finger at a time is inserted into the appliance for cleaning. A high pressure water jet, preferably pulsating, is discharged onto the end of the finger being cleaned. A soap or other liquid cleaning solution is conducted separately to where the water jet has just emerged from the jet nozzle, and here it becomes entrained with the jet so as to be sprayed onto the finger. A manually adjustable valve is provided for controlling the separate flow of this soap solution onto the water jet. Preferably, the water supply for the present appliance comes from a known type of high pressure, pulsating, water cleaning apparatus now in common use for oral hygiene.

A principal object of this invention is to provide a novel and improved water-operated appliance that is particularly adapted for cleaning the extremities of the hands or feet, particularly the finger nails.

Another object of this invention is to provide such an appliance having a novel arrangement for controlling the addition of soap or other cleaning solution to a water jet that is sprayed onto the finger.

Further objects and advantages of this invention will be apparent from the following detailed description of a presently preferred embodiment shown in the accompanying drawing in which:

FIG. 1 is a schematic perspective view showing the present cleaning appliance connected to a known type of pulsating, high pressure, oral hygienic implement;

FIG. 2 is a vertical longitudinal section of the present cleaning appliance before use;

FIG. 3 is a top plan view of this appliance;

FIG. 4 is a bottom plan view;

FIG. 5 is a horizontal cross-section taken along the line 5—5 in FIG. 2; and

FIG. 6 is a view similar to FIG. 2 and showing the appliance in use.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Referring first to FIG. 1, the appliance of the present invention is designated in its entirety by the reference numeral 10 and it is shown connected to the coupling 11 of a known type of implement which uses high pressure pulsations of water to clean the teeth and gums. This implement, sometimes known as a "Water Pik", includes a housing 12 containing a pump (not shown) whose inlet may be connected to a supply of water. This pump produces a pulsating flow of water at high pressure in a flexible conduit 13 leading to the coupling 11. As known, a jet nozzle device may be attached to this coupling for discharging pulsating jets of water that may be used for oral hygiene. As an illustrative example, the implement 11–13 may be generally of the type disclosed in U.S. Pat. No. 3,277,158.

In the preferred embodiment, the present appliance is provided with a flexible inlet hose 14 that is detachably connected at one end in any suitable manner to the coupling 11 to receive from it the high pressure pulsations of water. The opposite end of inlet hose 14 is connected by a suitable coupling 15 to the upper end of the appliance 10.

Referring now to FIG. 2, the present appliance comprises a receptacle having a rigid top end plate 16 of suitable material, a generally cup-shaped body 17 which is screw-threadedly attached to the periphery of plate 16, and a generally cylindrical body 18 which is screw-threadedly attached to the bottom of the cup-shaped body 17 and extends downward therefrom. A generally cup-shaped diaphragm 19 of suitable elastomeric material is mounted on the bottom of the cylindrical body 18.

The bottom 17*a* of the cup-shaped body 17 provides both the upper end wall of a cleaning chamber 20 and the bottom wall of a reservoir 21 in the appliance.

The cleaning chamber 20 is located inside the generally cylindrical body 18, and the elastomeric diaphragm 19 extends across the lower end of this chamber. As best seen in FIG. 4, this diaphragm presents a circular central opening 22 and a plurality of sectors 23 in succession circumferentially around this opening. These sectors 23 are separated by radial slits 24 formed in the elastomeric material of the diaphragm and extending outward from the central opening 22.

With this construction, as shown in FIG. 6, the sectors 23 of the diaphragm are flexible individually to permit the entry of a finger of an adult human hand inserted through the central opening 22. With the finger inserted, the sectored diaphragm closes the lower end of the cleaning chamber 20 almost completely, so that only a relatively small amount of liquid leakage can occur, at most.

The diaphragm 19 has an annular, upstanding, peripheral flange 25 with an inturned lip 26 at its upper end that fits snugly over a complementary, upwardly-facing, annular shoulder 27 on the body 18. The diaphragm flange 25 fits snugly around an outwardly offset, cylindrical segment 28 on the lower end of the body 18.

The top plate 16 of the receptacle is spaced above the bottom 17*a* of the cup-shaped body 17 and provides the top wall of the reservoir 21. The top plate carries a vertically disposed, centrally positioned tube 29, which preferably is formed integral with the top plate. This tube projects above the top plate, and the fitting 15 is attached to its upper end in liquid-tight fashion. The tube 29 projects down from the top plate 16 centrally through the reservoir 21, and it has an enlargement 29*a* which is snugly received in an upwardly-facing, central recess 30 formed in the bottom wall 17*a* of the cup-shaped body 17. Below the recess the tube extends down snugly through an opening 31 in wall 17*a* which leads down into the cleaning chamber 20. The lower end of the tube 29 is spaced below the receptacle wall 17*a*, and at this location the tube is internally screw-threaded to receive an externally screw-threaded, jet forming annular insert 32.

Above the insert 32, the tube 29 provides a passageway 29*b* for conducting water from the conduit 14.

The lower end of the tube 29 and the insert 32 together provide jet nozzle means for spraying water under high pressure and at high velocity down into the cleaning chamber 20. A series of replaceable inserts 32 having different jet orifices may be provided so that the user can select the jet spray pattern desired.

The receptacle wall 17*a* at the upper end of the cleaning chamber 20 is formed with a small diameter, vertical orifice 33 extending down from the reservoir 21 for the cleaning solution. This orifice is located to one side of the jet nozzle means on the lower end of the central, vertical tube 29. The receptacle wall 17*a* is formed with a thin web or rib 34 between the centrally located jet nozzle means and the orifice 33. As best seen in FIGS. 2 and 6, this web presents a bottom face 35 that is inclined downwardly and laterally inward from the lower end of the orifice 33 to the outside of the jet-forming insert 32 next to the latter's lower end, where the pressurized water emerges in a high velocity jet.

At the top face of the receptacle wall 17*a* the orifice 33 terminates in a frusto-conical valve seat 36 (FIG. 6). A manually adjustable valve 37 cooperates with this valve seat to either close the upper end of the orifice 33 or open it to the extent desired. This valve has a cylindrical, vertically-disposed stem with a frusto-conical lower end that is shaped complementary to the valve seat 36 for sealing engagement with the latter, when desired. The valve has a handle 38 on its upper end which overlies the top plate 16 of the receptacle. Immediately below this handle the valve has an externally screw-threaded segment 39 which is threadedly received in a complementary screw-threaded opening 40 in top plate 16. By grasping the valve handle 38 from above and turning it, the valve 37 may be turned from a position seated against the valve seat 36 and thereby blocking the gravity flow of the cleaning solution from reservoir 21 down through the orifice 33, as shown in FIG. 2, to an unseated position, as shown in FIG. 6. The rate of flow down through the orifice 33 depends upon how far the valve 37 is turned open. As shown in FIGS. 2 and 3, the top plate 16 of the appliance may have indicia on its top face to which the valve handle 38 points for indicating when the valve is closed and open respectively.

The top plate 16 of the receptacle has another screw-threaded opening 41, which threadedly receives an externally screw-threaded plug 42. The plug has a vent passage 43 whose inner (lower) end opens into the reservoir 21. The outer end of this vent passage extends laterally outward horizontally toward the wall of the top plate 16 at the opening 41. As shown in FIG. 2, when the plug 42 is tightened all the way down, its vent passage 43 is blocked at its outer end by the wall of the top plate 16 at the threaded opening 41. The plug may be turned from this position to unblock the outer end of its vent passage 43, as shown in FIG. 6, by positioning this outer end completely above the top plate 16 at the threaded opening 41 in the latter. Thus, the plug may be turned clockwise or counterclockwise to block or unblock the vent.

OPERATION

The plug 42 is removed from the receptacle and the reservoir 21 is filled with a suitable liquid cleaning solution, such as a soap-and-water or detergent-and-water solution. The conduit 14 is attached to the fitting 11 of the known cleaning implement. If the appliance is to be used right away, the plug 42 is screwed back in only to a position as shown in FIG. 6, in which it vents the top of reservoir to the atmosphere. The user may insert his finger through the diaphragm 19, as shown in FIG. 6, so that his finger nail is closely below the jet nozzle means.

When the pump in the cleaning implement is turned on, high pressure pulsations of water are conducted through the flexible conduits 13 and 14 into the passageway 29*b* leading down into the jet nozzle means, where it is discharged in the form of pulsating jets that spray against the finger nail as shown in FIG. 6. Soap or detergent may be added to this water jet spray by opening the valve 37, which permits the liquid soap solution to pass from the reservoir 21 down through the orifice 33, and then to flow down along the inclined bottom surface 35 of web 34 to the lower end of the jet-forming insert 32 in the jet nozzle means, where it becomes entrained with the high velocity water jet coming out of the nozzle.

When the device is not in use the valve 37 is closed, and also the plug 42 is turned to its fully-closed position (FIG. 2) in which its vent passage 43 is closed at the outer end.

If desired, the present cleaning appliance may be slightly modified structurally to enable its use for cleaning the toe nails. In that event, the body 18 and diaphragm 19 would be replaced by an assembly designed for the toe nails, but the cup-shaped body 17 and the top end plate 16 (including the water tube 29) would not have to be replaced.

Also, if desired, this appliance may be connected directly to a water faucet which would serve directly as the source of pressurized water in the absence of the known pulsating-type cleaning implement shown in FIG. 1. However, a hydraulic pulsating amplifier may be included in the connection to the water faucet, if desired.

I claim:

1. A personal cleaning appliance for using pressurized water to clean the extremities of a person's hand or foot comprising:

a receptacle defining a cleaning chamber for receiving the extremity to be cleaned;

means on said receptacle at one end of said cleaning chamber for the insertion of the extremity to be cleaned;

jet nozzle means for discharging pressurized water into said cleaning chamber;

means for connection to a water source having a water passage there through leading to said jet nozzle means for passing pressurized water thereto;

passage means leading into said chamber adjacent said jet nozzle means for conducting a liquid cleaning solution separately from said water passage onto the pressurized water after discharge from said jet nozzle means in said cleaning chamber for entraining the liquid cleaning solution with the water; and valve means between said reservoir and said jet nozzle means for controlling the flow of cleaning solution from said reservoir to said jet nozzle means;

said valve means being cooperable with said passage means for selectively opening and closing the same.

2. A personal cleaning appliance for using pressurized water to clean the extremities of a person's hand or foot comprising:

a receptacle defining a cleaning chamber for receiving the extremity to be cleaned and defining a reservoir above said cleaning chamber for holding a quantity of liquid cleaning solution;

said receptacle presenting an upper end wall extending across the upper end of said cleaning chamber with said reservoir located directly above said end wall;

said end wall of said cleaning chamber having orifice means extending downward therethrough for passing the cleaning solution from said reservoir down into said cleaning chamber;

means on said receptacle at one end of said cleaning chamber for the insertion of the extremity to be cleaned;

jet nozzle means positioned by said end wall of said cleaning chamber adjacent to said orifice means for discharging pressurized water into said cleaning chamber;

means for connection to a water source and having a water passage therethrough leading to said jet nozzle means for passing pressurized water thereto;

said orifice means serving in operation to conduct the liquid cleaning solution separately from said water passage onto the pressurized water after discharge from said jet nozzle means for entraining the liquid cleaning solution with the water; and valve means between said reservoir and said jet nozzle means for controlling the flow of cleaning solution from said reservoir to said jet nozzle means;

said valve means being cooperable with said orifice means for selectively opening and closing said orifice means.

3. An appliance according to claim 2, wherein:

said receptacle has a top end wall spaced above said upper end wall of said cleaning chamber;

and said valve means presents a handle above said top end wall and is threadedly mounted in said top end wall to be turned between a position closing said orifice and a position opening said orifice.

4. An appliance according to claim 2, wherein:

said upper end wall of the cleaning chamber carries a surface that is inclined downwardly and laterally from the lower end of said orifice over to said jet nozzle means for conducting the cleaning solution onto the pressurized water discharge at the outlet of said jet nozzle.

5. An appliance according to claim 4, wherein:

said receptacle has a top end wall spaced above said cleaning chamber;

and said valve means presents a handle above said top end wall and is threadedly mounted in said top end wall to be turned between a position closing the upper end of said orifice and a position opening the upper end of said orifice.

6. An appliance according to claim 2, wherein:

said receptacle has a screw-threaded opening leading into said reservoir above said cleaning chamber;

and further comprising:

a plug threadedly mounted in said opening, said plug having a vent passage therein which at its inner end opens into said reservoir, said vent passage having its outer end blocked by the wall of said reservoir at said screw-threaded opening in one rotational position of the plug and having its outer end open beyond said last-mentioned wall in another rotational position of the plug in said screw-threaded opening.

7. An appliance according to claim 2 wherein said means for the insertion of an extremity to be cleaned comprises:

an elastomeric flexible diaphragm extending across said one end of said cleaning chamber and comprising a plurality of flexible and resilient sectors in succession circumferentially around a central opening for passing the user's extremity.

* * * * *